United States Patent [19]

Hartmann

[11] 3,998,125

[45] Dec. 21, 1976

[54] BELT FEEDER FOR AN AUTOMATIC WEAPON

[75] Inventor: Rolf Hartmann, Dusseldorf, Germany

[73] Assignee: Rheinmetall GmbH, Dusseldorf, Germany

[22] Filed: July 29, 1974

[21] Appl. No.: 492,874

[30] Foreign Application Priority Data

Aug. 3, 1973 Germany ..... 2339311

[52] U.S. Cl. ..... 89/33 CA

[51] Int. Cl.[2] ..... F41D 9/02

[58] Field of Search ..... 89/33 BA, 33 BC, 33 CA

[56] References Cited

UNITED STATES PATENTS

| | | | |
|---|---|---|---|
| 317,161 | 5/1885 | Maxim | 89/33 CA |
| 863,101 | 8/1907 | Schwarzlose | 89/33 CA |

*Primary Examiner*—Stephen C. Bentley

*Attorney, Agent, or Firm*—Ernest G. Montague; Karl F. Ross; Herbert Dubno

[57] ABSTRACT

A belt feeder for loading an ammunition belt into an automatic weapon has a feeder starwheel driven stepwise in dependence on the weapon function and is provided with an ammunition-belt inlet-chute which progressively narrows in a substantially spiral fashion and extends angularly around the feeder starwheel over approximately 90°.

3 Claims, 6 Drawing Figures

Prior Art

BELT FEEDER FOR AN AUTOMATIC WEAPON

FIELD OF THE INVENTION

The invention relates to a belt feeder for automatic weapons, particularly machine guns and machine canons driven in a stepwise manner by a feeder starwheel operated by gas pressure or other means in dependence on the requirements of the weapon.

BACKGROUND OF THE INVENTION

In machine guns of conventional types the ammunition belt is continuously subjected to brief and relatively large accelerations, leading to considerable stress on the belt and thereby causing an elongation or stretching thereof within the elastic range of the belt members, resulting in a change of the desired separation distance between cartridges or shells carried by the belt. This frequently causes either functional disturbances in the case of known starwheel feeders, the belt on the cartridge becoming jammed between the starwheel feeder and the wall of the belt inlet as a result of such changed separation distances between the cartridges or shells, or results in unfavorable force-transmission ratios between the teeth of the starwheel feeder and the cartridges or shells. This danger is increased if, for example, belt lengths of the order of 1 to 2 meters are required to be pulled in by the starwheel feeder.

Rotary bending or overlapping of the belt from the munition supply to belt feeder also causes increased pulling forces to be applied to the belt which, together with the stepwise accelerations to which the belt is subjected, cause an elongation thereof, the cartridges being thereby additionally displaced in a longitudinal direction with respect to the belt members enveloping them. For this reason it has been customary to date to provide centering adjustments ahead of the belt feeder, in which the cartridges are made to resume their original position to ensure a disturbance-free entrance into the belt feeder.

OBJECTS OF THE INVENTION

It is therefore an object of my invention to obviate the above disadvantages and to improve a belt feeder of the aforesaid type to obtain a satisfactory entrance of the munition belt into the belt feeder and thereby ensure a trouble-free ammunition supply to the weapon even when the belt is subjected to large pulling forces.

SUMMARY OF THE INVENTION

A belt feeder for loading an ammunition belt into an automatic weapon has feeder and transport starwheels, the transport starwheel being in the same plane as the feeder starwheel, driven synchronously in a stepwise fashion and engaging cartridges on a belt; it is also provided with an ammunition belt inlet chute which progressively narrows in a substantially spiral fashion and encompasses the feeder starwheel over approximately 90°. The ammunition belt, which advances in dependence on the weapon function, has belt members for strapping cartridges thereon, the cartridges being unstrapped from the belt prior to entering the weapon. The inlet chute is formed on its top sides with wedge-shaped inlet surfaces and guiding edges for guiding the cartridges and belt members. Special centering arrangements are no longer required; the invention is applicable to starwheel belt-feeders having both a direct cartridge supply, where strapped cartridges are fed directly to an outlet being displaced by the breech in a longitudinal direction and made to leave an encompassing belt member, and an indirect cartridge supply where the strapped cartridges are already ejected within the region of the starwheel from the respective belt members and arrive separately at an outlet slit. Stretching of the belt and a consequent increase of the separation distance is avoided by the starwheel engaging the respective cartridges and guiding them along a narrowing guide path where the separation of the cartridges takes place.

BRIEF DESCRIPTION OF THE DRAWING

These and other features of the invention will be better understood with reference to the accompanying drawing in which.

SPECIFIC DESCRIPTION

Figure 1:
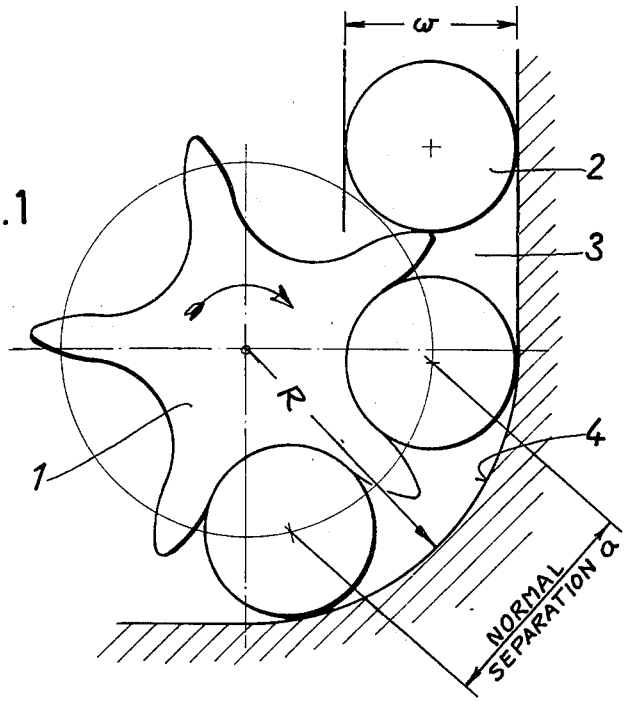
FIG. 1 diagrammatically illustrates a feeder starwheel of the prior art in fragmentary elevational cross-section.
Figure 2:
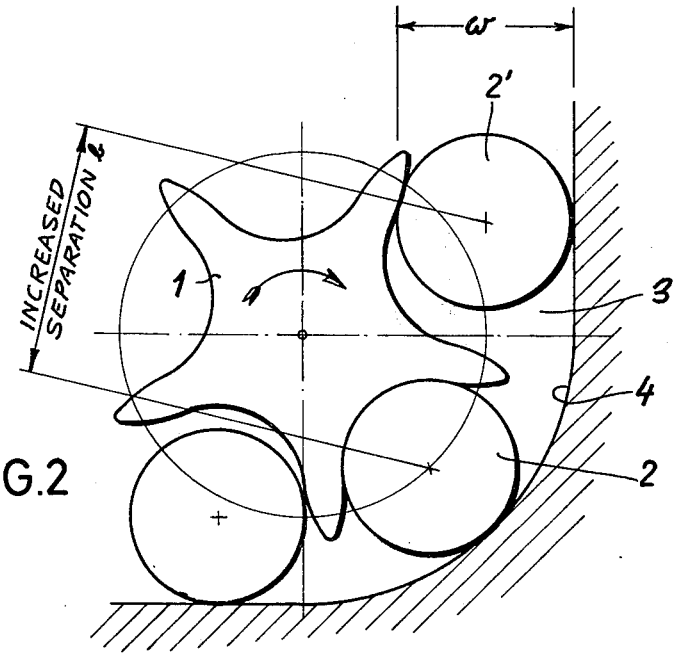
Prior Art FIG.2
FIG. 2 is a similar view which illustrates the increased separation distance due to a conventional starwheel feeder of the type illustrated in FIG. 1.

FIGS. 1 and 2 show in schematic fashion the operation of a conventional belt feeder for a weapon. A belt containing shells or cartridges 2, which are kept at a normal or separation distance from each other, is fed through a chute 3, and a feeder starwheel 1 is driven stepwise in dependence on the weapon function in the direction of the arrow shown to advance the belt. Belt members 9 have been omitted for clarity's sake from FIGS. 1 and 2, although they have been shown in FIG. 5. The outer wall of chute 3 having a width $w$, corresponding roughly to the diameter of shells 2, assumes a part-circular shape in the vicinity of starwheel feeder 1, the chute having a radius R approximately equal to the root radius of the starwheel plus twice the radius of the shell.

As a result of increased belt tension an increased separation distance between shells may result which is depicted in FIG. 2. It is obvious that an unfavorable force-transmission-ratio between shell 2′ and the tooth of the starwheel making contact with the latter will result, which may in turn lead to the aforesaid functional disturbances of the feeder starwheel and the weapon.

Figure 3:
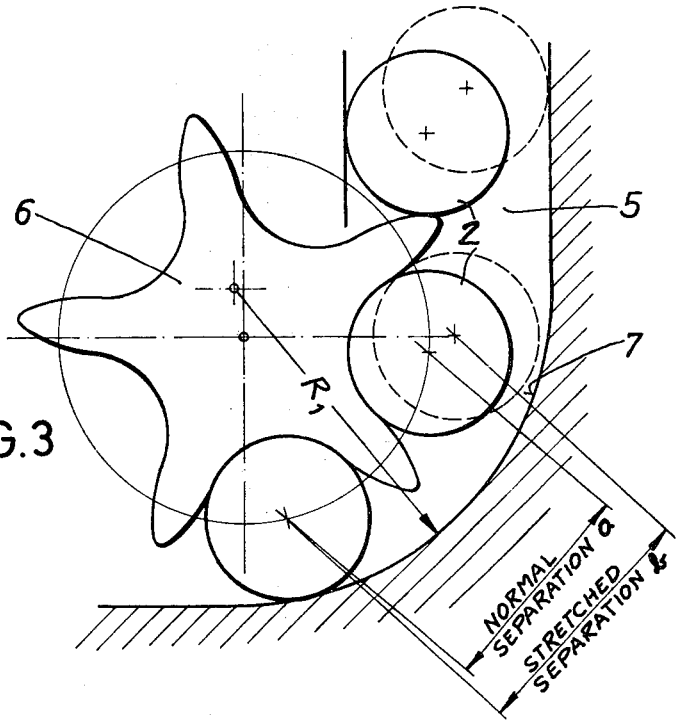
FIGS. 3 and 4 are diagrams which illustrate the improvements obtainable according to the invention in views corresponding respectively to FIGS. 1 and 2.
Figure 4:
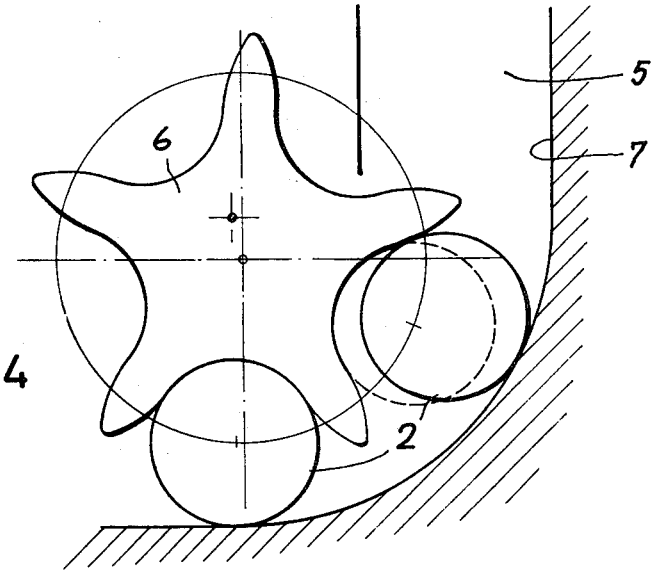

FIGS. 3 and 4 show a similar situation using a chute 5 formed according to my invention. Chute 5 is initially wider than chute 3, but is made to be progressively narrower over a region or central angle $\alpha$ of about 90° encompassing starwheel 6, finally reaching the diameter of shell 2. The part-circular shape of outer wall 7 now has a radius $R_1$ approximately equal to the radii of starwheel 6 plus that of the shell and the incremental width of chute 7 exceeding that of chute 3, that incremental width amounting to about 20 to 25% of the diameter of the cartridge or shell.

Cartridges or shells 2 contained within a belt not illustrated in FIGS. 3 and 4 are separated by a distance *a*. As a result of a considerable force acting on the belt the latter is stretched, increasing the separation distance to a length *b*, with cartridges 2 consequently assuming positions shown dotted in FIG. 3. Upon rotation of starwheel 6, cartridges 2 bordering wall 7 are engaged by the teeth of starwheel 6 as illustrated in FIG. 4, thereby sliding the former along wall 7, the latter progressively narrowing the width of chute 5 and therefore reducing the cartridge separation-distance to the original separation distance *a*.

Figure 5:
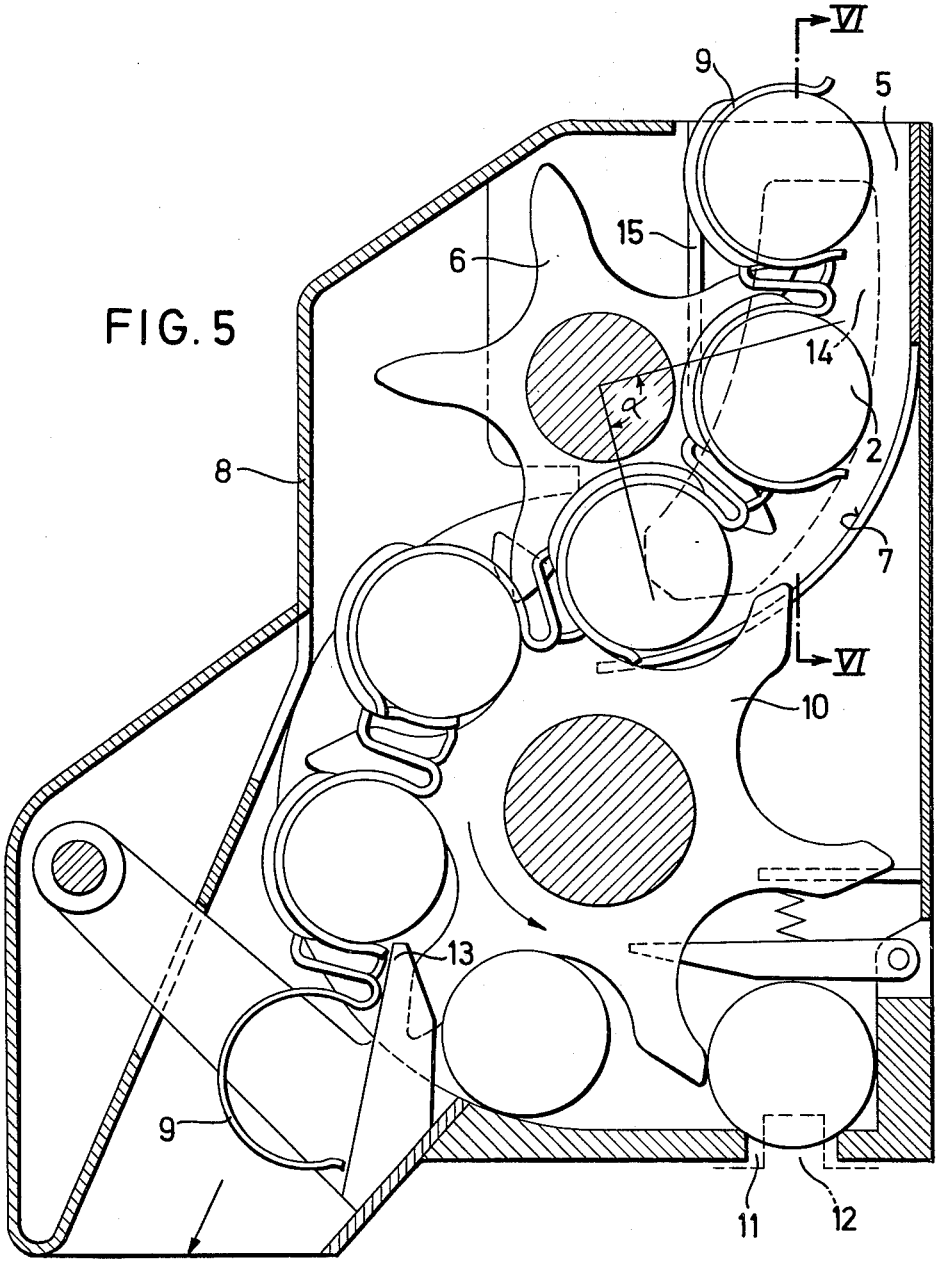
FIG. 5 is a fragmentary elevational view of a belt feeder having two starwheels and the unstrapping of the cartridges.
Figure 6:
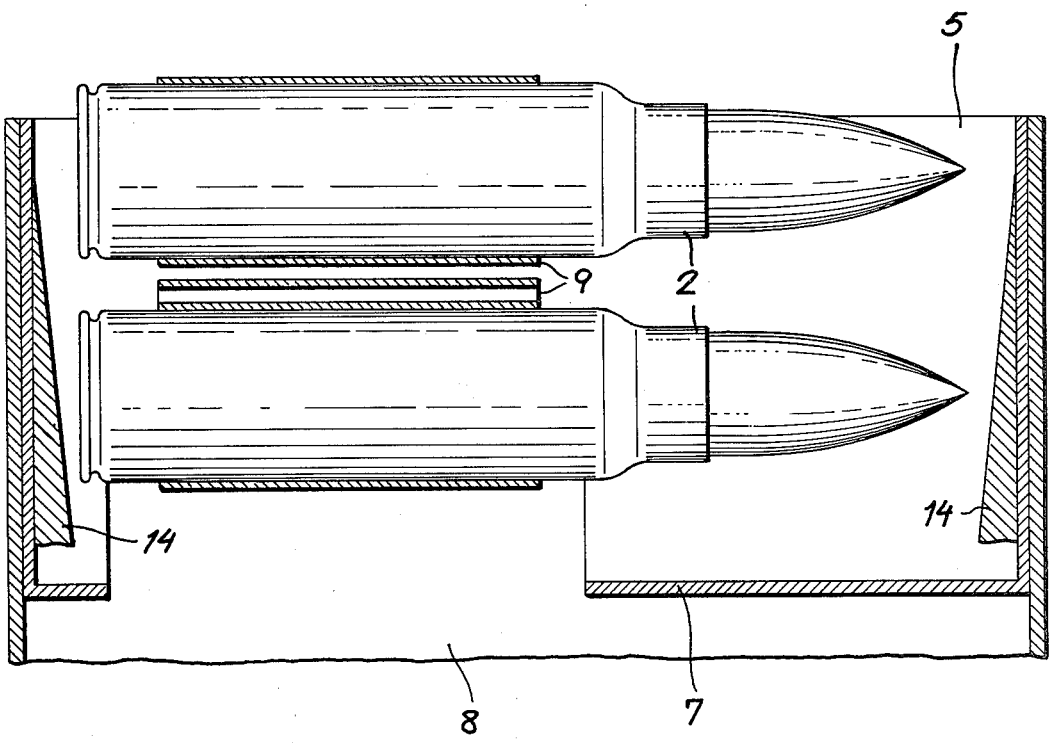
FIG. 6 is a fragmentary cross-section of FIG. 5 along line VI — VI.

FIG. 5 shows a starwheel belt feeder, where the cartridges or shells are unstrapped prior to being loaded onto the weapon. The belt, being made up of belt members 9 carrying cartridges or shells 2, is introduced to the belt feeder through chute 5. In a housing 8 of the belt feeder there is arranged in a plane parallel to feeder starwheel 6 a transport starwheel 10. Starwheels 6 and 10 are always coupled to each other through a cartridge 2 still attached to the belt, so that the starwheels are therefore effectively driven synchronously, necessitating a drive for only one of the starwheels. Prior to reaching a discharge slit 11, where cartridges 2 are dispatched by a breech 12 to the loading chamber of the weapon, which is not shown in FIG. 5, the former are stripped from the belt in a conventional manner at a location 13, belt members 9 being tangentially slid off, and cartridges 2 being discharged therefrom by the rotation of starwheel 10. The top sides of chute 5 are formed within the region of feeder starwheel 6 with wedge-shaped inlet surfaces 14 and guide edges 15 for guiding belt members 9 and cartridges 2, belt members 9 being thereby centered to an appropriate position requisite for guiding the latter in a disturbance-free fashion.

I claim:

1. A belt feeder for loading an ammunition belt into an automatic weapon having a feeder starwheel driven stepwise in dependence on the weapon function comprising an ammunition-belt inlet-chute progressively narrowing in a substantially spiral fashion and encompassing said feeder starwheel over about 90°, said cartridges being unstrapped from said belt prior to entering said weapon, and a transport starwheel in a plane parallel to that of said feeder starwheel and synchronously driven therewith, said starwheels engaging each other via a belt-strapped cartridge.

2. A belt feeder as defined in claim 1 wherein said inlet chute has sides formed with wedge shaped inlet surfaces and guide edges for guiding said cartridges and said belt.

3. A belt feeder for an automatic weapon having a starwheel driven stepwise to advance a munitions belt carrying a succession of cartridges, the improvement which comprises a wall spaced from and extending arcuately over an angle of about 90° about the periphery of said starwheel and defining and inlet chute for said cartridges having an inlet end and an outlet end, said wall having generally the configuration of a spiral progressively approaching said starwheel from said inlet end to said outlet end, and a transport starwheel lying in a plane parallel to the first-mentioned starwheel and having teeth overlapping the teeth of said first starwheel laterally adjacent said first starwheel, said starwheels being driven synchronously, said starwheels being constructed and arranged to simultaneously engage a common cartridge thereby entraining one of said starwheels with the other.

* * * * *